US005520133A

United States Patent [19]

Wiegert

[11] Patent Number: 5,520,133

[45] Date of Patent: May 28, 1996

[54] WATER JET POWERED WATERCRAFT

[76] Inventor: Gerald A. Wiegert, 3639 Emily St., San Pedro, Calif. 90732

[21] Appl. No.: 422,898

[22] Filed: Apr. 17, 1995

[51] Int. Cl.[6] ..... B63B 39/03

[52] U.S. Cl. ..... 114/125; 440/38

[58] Field of Search ..... 114/121, 123, 114/125, 271, 274, 289, 270; 440/38, 39, 40, 41, 42, 43

[56] References Cited

U.S. PATENT DOCUMENTS

| | | | |
|---|---|---|---|
| 3,948,206 | 4/1976 | Tyler . | |
| 4,030,443 | 6/1977 | Price | 114/270 |
| 4,101,997 | 7/1978 | Tyler . | |
| 4,775,341 | 10/1988 | Tyler . | |
| 4,875,426 | 10/1989 | Soga et al. | 114/270 |
| 5,060,591 | 10/1991 | Ciavarra | 114/125 |
| 5,113,777 | 5/1992 | Kobayashi | 114/270 |
| 5,150,662 | 9/1992 | Boyd et al. | 114/270 |
| 5,184,564 | 2/1993 | Robbins et al. | 114/270 |

*Primary Examiner*—Stephen Avila
*Attorney, Agent, or Firm*—Harlan P. Huebner

[57] ABSTRACT

A motorcycle like configured watercraft that employs a hull member to receive an engine and water jet nozzle means to propel the craft and the craft includes a seat area for a rider and steering means to control the direction of the craft. In addition, the craft includes a separate front ski member that has a water ballast chamber that may be connected to the steering means, and a pair of side skirts secured to the hull that contains water ballast chambers. The water ballast chambers designed to be capable of becoming quickly flooded when the craft is at rest to partially submerge the craft for ease of entry of the rider and means to cause rapid evacuation of the water in the chambers as the craft increases speed to raise the craft without restriction to its running and planing position.

25 Claims, 5 Drawing Sheets

FIG. 11
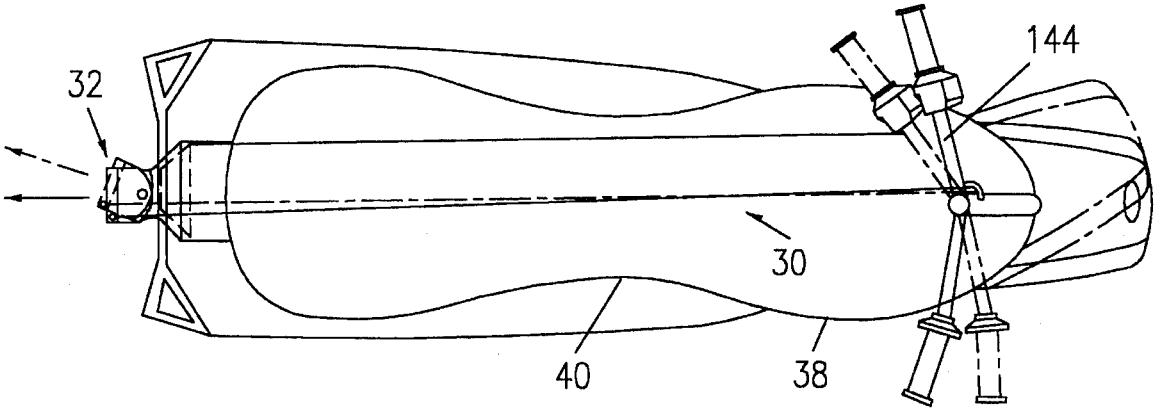
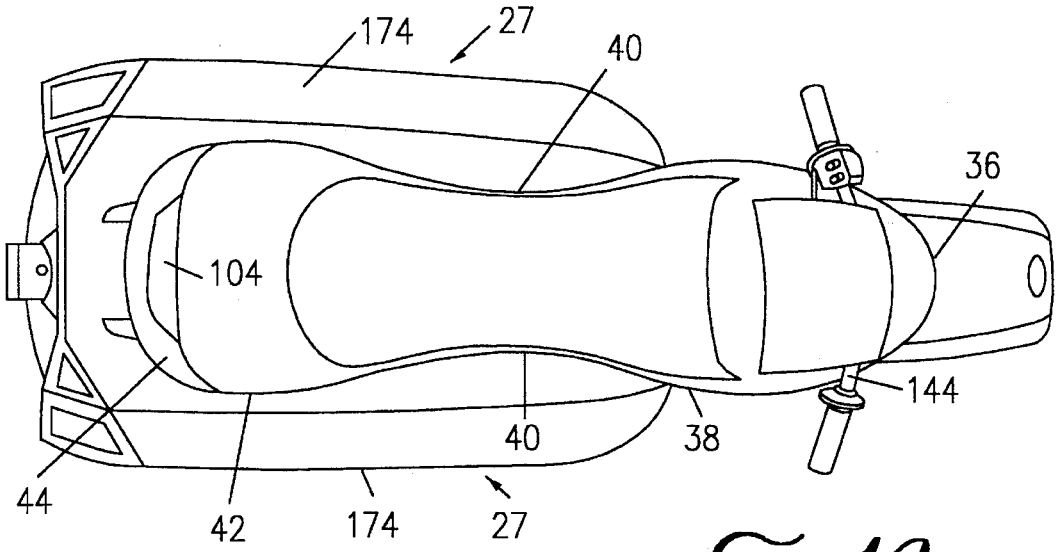
FIG. 12
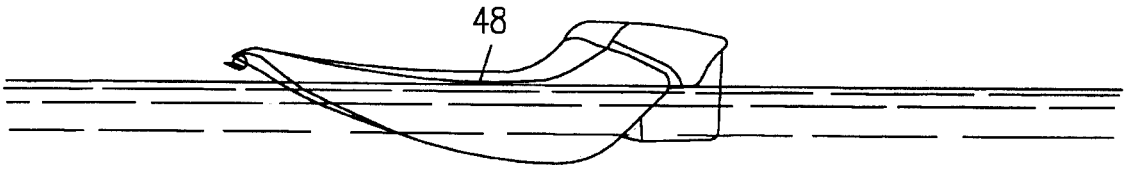
FIG. 13

WATER JET POWERED WATERCRAFT

BACKGROUND OF THE INVENTION

1. Field of the Invention

The present invention relates to a water jet powered motorcycle like configured watercraft and more particularly to a craft which when at rest is semi submersed for ease of mounting and balance when the rider is on board.

2. Description of the Prior Art

The present jet powered watercrafts or "Jet Ski" type of crafts normally are buoyant and ride high on top of the water when at rest or during movement. There is a disadvantage with such construction in that when it rides high in the water it is difficult for a person to mount the watercraft and to keep the unit balanced. It requires the person to actually be far above the center of buoyancy so should the craft tip over during use it is difficult to right and also it is difficult to mount.

In addition, some of the present watercraft have relatively narrow foot boards and thus stabilization is effected. Further, the present products do not have the capability of varying the width or customizing the craft dependent upon the skill of the rider.

Further, the prior art does not possess the capability of dual steering capacity both in front and in the back by movement of a jet nozzle.

SUMMARY OF THE INVENTION

The purpose of the present invention is to provide a water jet powered watercraft that includes a plurality of ballast cavities to fill with water in an at rest position so that the watercraft may submerge which will make the seating of a person on that craft much easier as it will be below the person and partially under water.

Another object of the present invention is to provide water inlet cavities within the watercraft to fill with water when at rest, yet upon forward movement of the watercraft the water is expelled and the watercraft rises to the surface of the water or near the surface wherein the total draft area or "drag" is reduced so the watercraft may move faster in the water.

It is also a further object of the present invention to provide a watercraft with a steerable front ski and also a steering mechanism that may simultaneously angle the jet nozzle to assure further direct steering capabilities to the watercraft.

A yet further object of the present invention is to provide side skirts that are added to the craft and additional skirts of lesser or greater width may be added thereto dependent for stabilization dependent upon the skill and age of the rider to customize the craft. Thus acting as a non-surface piercing hydrofoil effect.

A still further object of the present invention is to provide mechanism to control the opening of the jet nozzle to vary the thrust.

Another object of the present invention is to provide a version of the watercraft that is constructed with its beam being approximately twenty four inches across. Such a construction creates a smaller width bottom surface so that when the craft is being turned the chance of bottom exposure out of the water is reduced. Thus without being out the water the intake for water to a jet pump will not also allow air therein causing unwanted cavitation of the jet pump. The surface as well as the water intake will remain under water.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which:

FIG. 11 is a top view of the present invention showing the dual steering equipment;

FIG. 12 is a top elevational view of the present invention with modified skirt construction; and FIG. 13 is a side elevational view of the seat of the present invention used as a floatation device.

DETAILED DESCRIPTION OF THE PREFERRED EMBODIMENT

Figure 1:
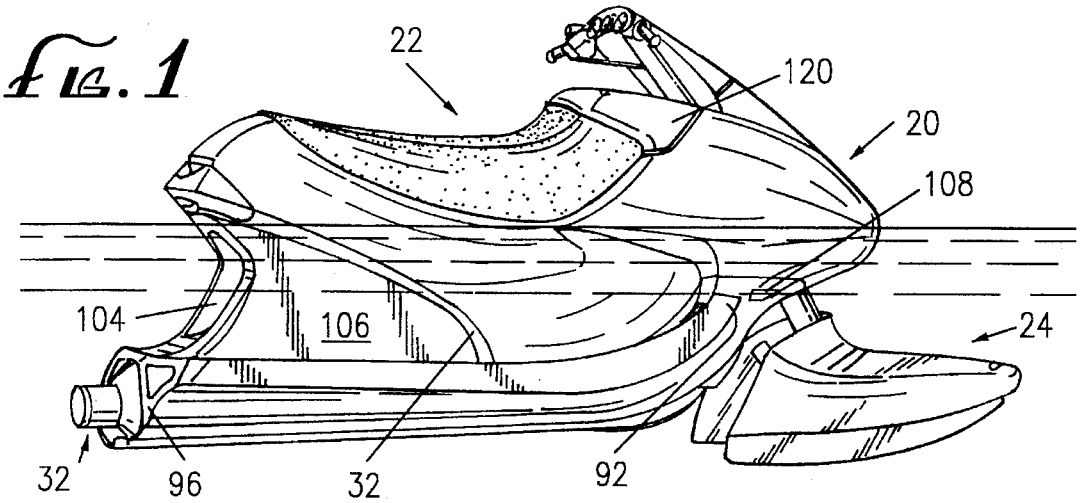
FIG. 1 is a side elevational view of the water jet powered watercraft of the present invention.

FIG. 1 illustrates a watercraft or jet powered water ski generally designated 20. The craft 20 includes two main portions a generally elongated hull designated 22 and a front ski member designated 24. In addition, there are a pair of side skirt members designated 26, best seen in FIG. 5 that are mounted to hull 22. A pair of additional skirt members 27 FIG. 12 of different dimensions may be attached to side skirts 26 depending upon the ability of the user of the watercraft to assure greater stability of the craft.

Figure 5:
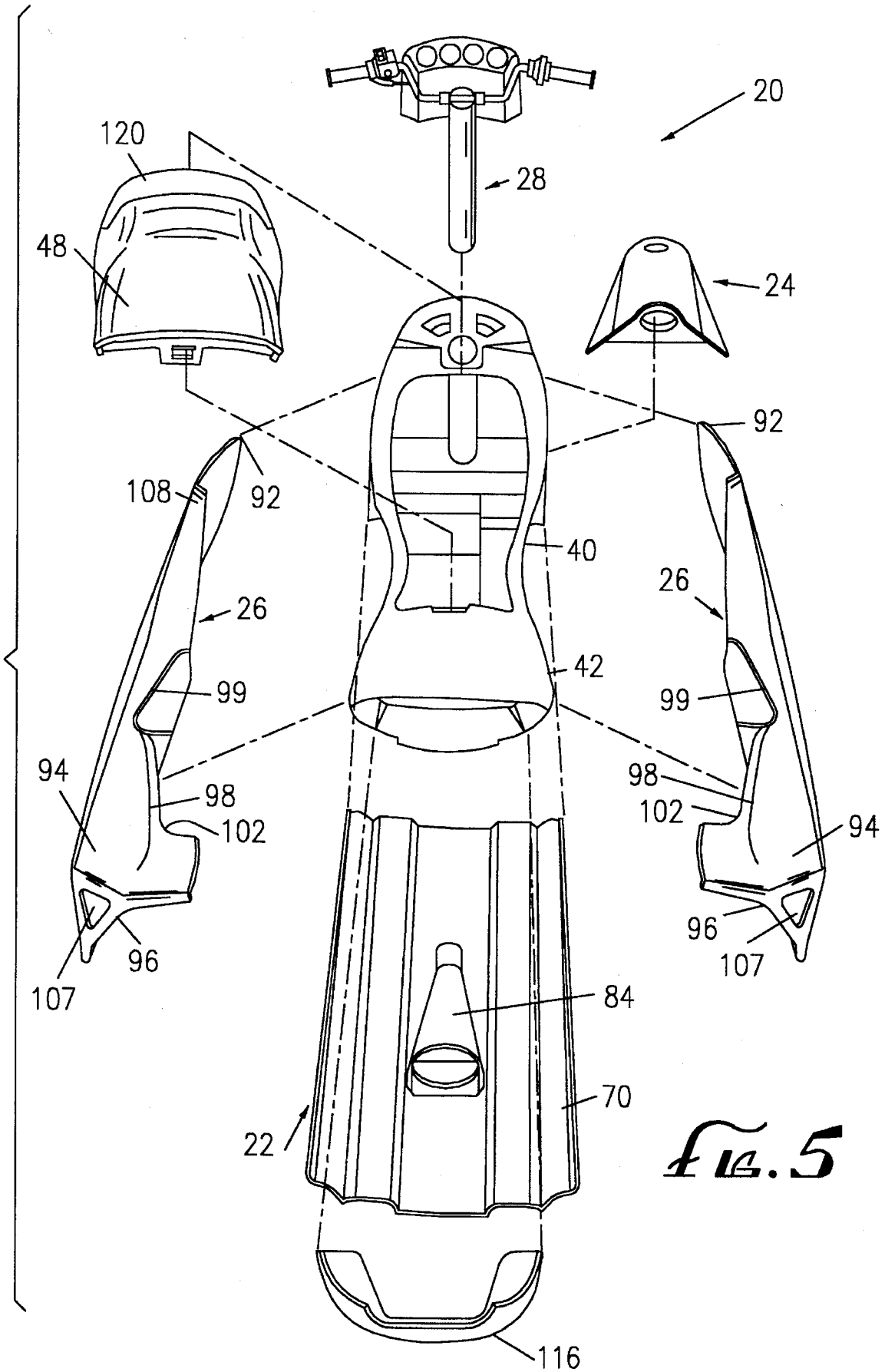
FIG. 5 is prospective exploded view of the watercraft of FIG. 1.

The watercraft 20 also includes a front steering mechanism designated 28, best seen in FIG. 5 to steer the craft and direct the movement of the front ski member 24. In addition, there is a secondary hull steering mechanism designated 30 to rotate a propulsion jet nozzle designated 32 as best seen in FIG. 11.

Turning now to the watercraft 20 in more detail the elongated hull 22 may be molded from plastic and includes a generally rounded front end 36 as best seen in most of the figures. The front end 36 merges into side panels 38 that are elongated and curved to form a generally hour glass shape with an indentation on each side at 40 where riders legs will straddle the hull 22 and extend downward in the indentation.

Rearwardly of the indentations 40 the side panel 38 flare out at 42 and merge into a curved rear end 44 between the flared portion 42.

Figure 2:
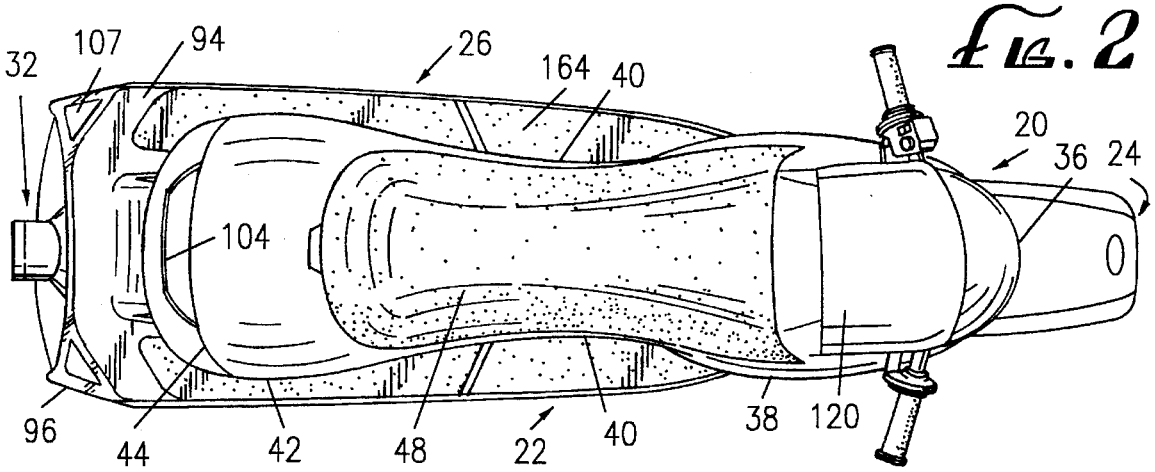
FIG. 2 is a top elevational view of the watercraft of FIG. 1.
Figure 6:
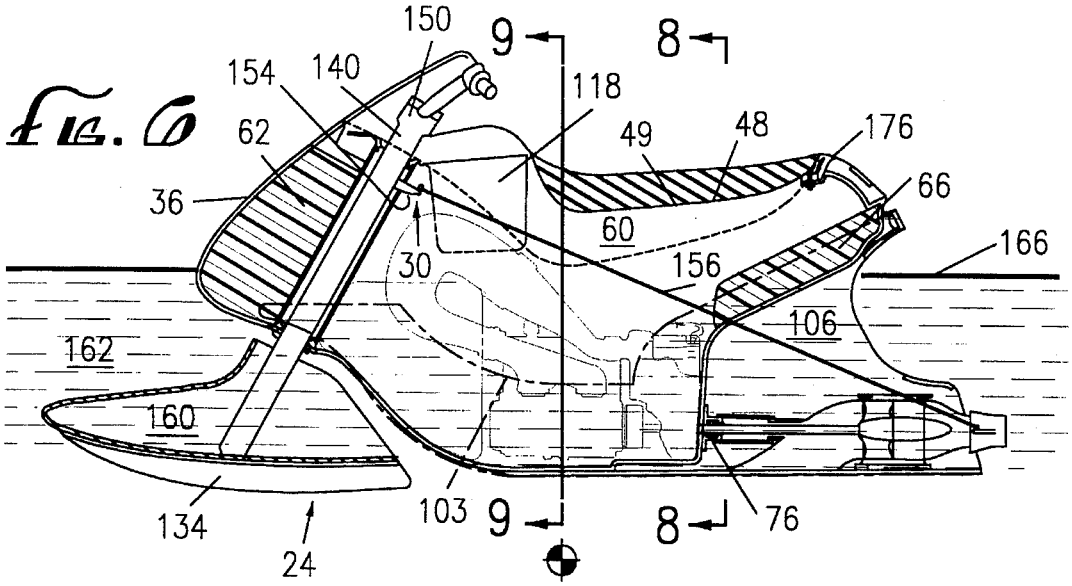
FIG. 6 is a side elevational cross sectional view showing the watercraft of the present invention at rest and partially submersed.
Figure 6A:
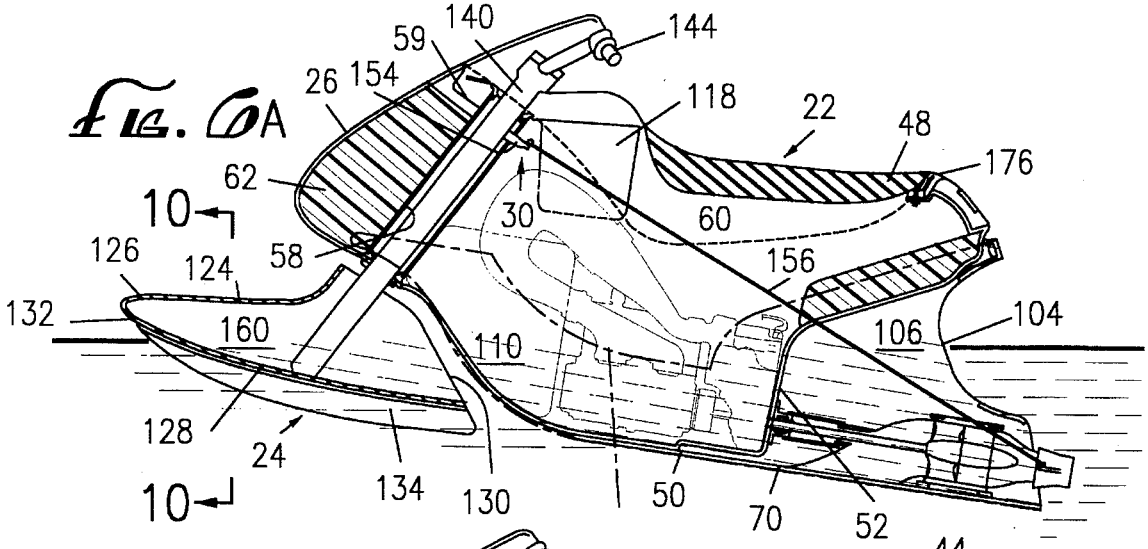
FIG. 6A is side elevational cross-sectional view of the watercraft in an elevated condition beginning to emerge from the water toward its running position.
Figure 7:
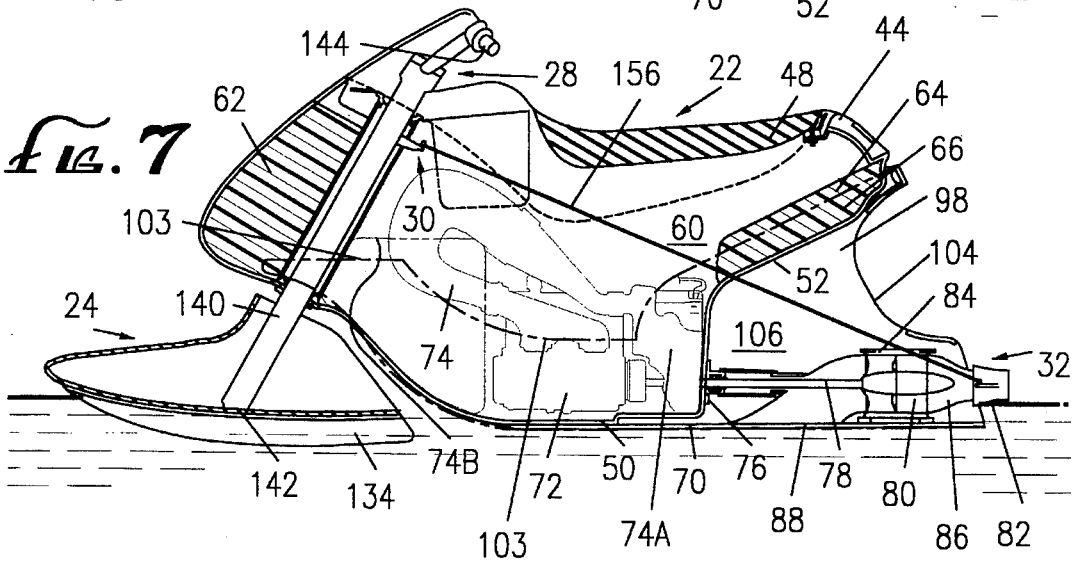
FIG. 7 is a side elevational view of the watercraft of the present invention fully emerged in its running position.
Figure 8:
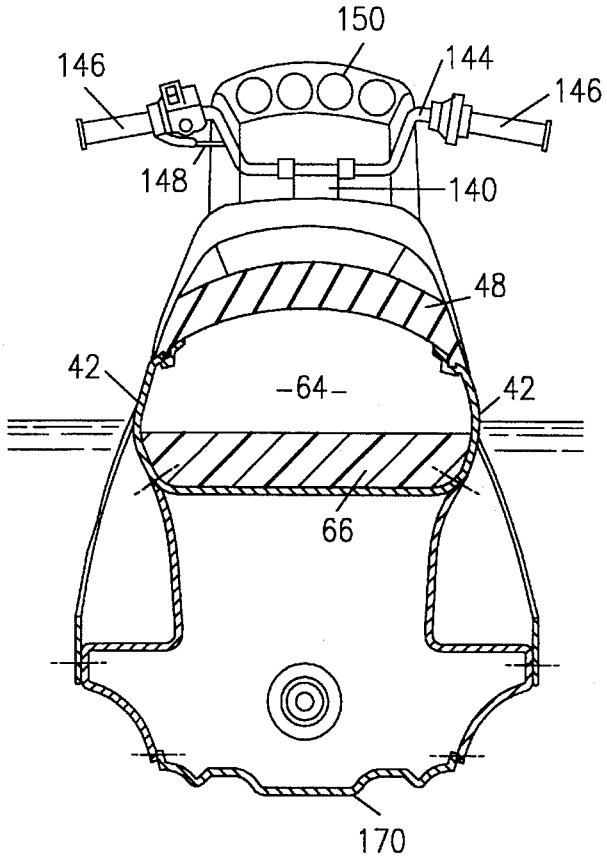
FIG. 8 is a rear cross sectional elevational view of the watercraft taken on line 8—8 of FIG. 6.

The hull 22 in cross section, see FIGS. 6, 6A or 7 includes a seat portion 48 which is preferably formed of foam for comfort that is secured to the surface 49 of the hull. As seen in FIGS. 1, 2 and 8 it is curved for a rider to sit on it and may be detached to use as a flotation device, see FIG. 13.

The bottom 50 is generally flat and extends forward from undercut rear end 52 and upward to join the rounded front end 36.

Adjacent the front end 36 there is a steering shaft tube 58 that extends downward from the hull top 59 through the interior of the hull 22 to the bottom 50. As best seen in FIGS. 6, 6A and 7 the tube 58 is upright and slightly angled relative to the vertical. To be described is the steering mechanism associated therewith.

Positioned in a water tight motor cavity 60 (the interior of hull 22) against the curved front end 36 of the hull 22 is preferably placed floatation foam 62. In addition, there is preferably mounted within motor cavity 60 an addition piece of floatation foam 66. An air passage 64 opens inwardly from the hull top 49 and communicates with the water tight motor cavity 60. The purpose is to allow air to enter the cavity where a convention internal combustion gas engine 72 is mounted on bottom 50 and will act as a keel when the craft is submerged.

Mounted below bottom 50 and extending rearwardly is an elongated exterior bottom plate 70 having a cross section to act as a stabilizing means to prevent swaying from side to side of the craft.

The engine 72 includes a conventional watercraft exhaust system 74 that includes a muffler 74*a* that will preferably exit out the side of the hull 22 below the water line. However, the engine 72 and exhaust system 74 are not a part of the present invention. There is also provided a fuel tank 74*b* mounted in the water tight chamber.

In addition there is a conventional drive shaft coupling 76, FIGS. 6, 6A and 7 that is mounted on the rear undercut wall 52. Extending from the motor 72 through a seal in the wall 52 and coupling 76 is a drive shaft 78 extending to a water pump 50 having propellers or impellers connected to a conventional water jet nozzle 82. The nozzle may be swivel mounted for side to side movement as well as up and down movement for trim depicted in FIG. 11. The waterpump 80 is mounted on the exterior bottom plate 70 as well as side skirts 26.

The water pump 80 has a housing 84 that spans a water intact channel 84 that extends from the plate 70 upward and rearwardly terminating in a tapered water jet throat 86 to which the jet nozzle 82 is mounted. The bottom plate 70 has an opening 88 so that water may be sucked in through opening 88 by the impellers of the pump 80 and discharged with increased velocity through the throat into the jet nozzle 82 where it exits with additional thrust to cause propulsion of the watercraft 20.

To form a housing around the drive shaft and pump 80 said side skirt members 26 are positioned. The skirt members are preferably molded of the same material as the hull 22 and are best illustrated in FIG. 5. These skirt members 26 serve as a portion of the ballast parts of the watercraft 20 to allow the same to become partially submerged when idle as shown in FIG. 6.

Figure 9:
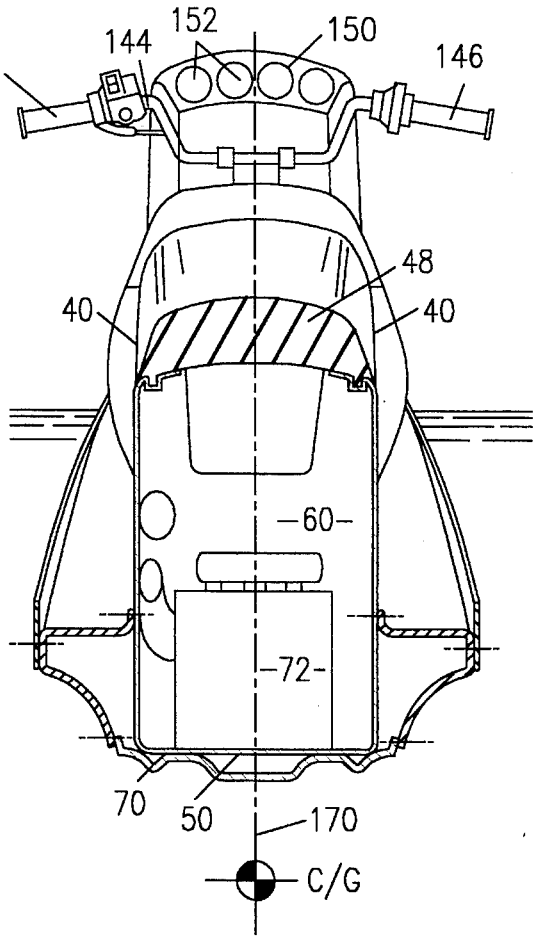
FIG. 9 is a rear cross sectional elevational view of the watercraft on line 9—9 of FIG. 6.

Generally the side skirts 26 are hollow and each wraps around the side panels 38 of the hull 22 and engage the side panels 38 and extend rearwardly to engage and connect to exterior bottom plate 70, as best seen in FIG. 9.

Figure 3:
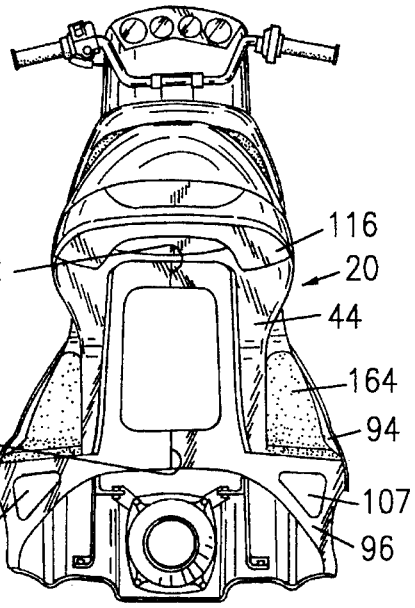
FIG. 3 is a rear elevational view of the watercraft of FIG. 1.
Figure 4:
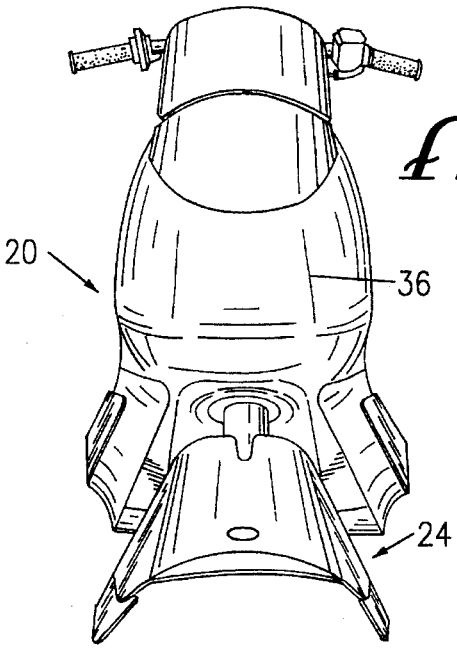
FIG. 4 is a front elevational view of the watercraft of FIG. 1.

The skirts 26 each include a pointed front end 92 to conform to the side panel 38. They each include a generally flat top surface 94 that becomes the foot rests for the rider or riders. Adjacent the rear end 96 of the skirt 26 are upward projecting fin like portions 98 that are curved at their tops 99 to fit the undercut rear end of hull 22. The fin portions 98 bend inwardly toward each other with flanges 100. When the two flanges 100 butt together, see FIG. 3, the edges 102 contact each other. As the flanges 100 are cut out when the skirts are butted together and secured by fastening means to the hull a water opening 104 is formed. The joined skirts 24 and exterior of hull 22 form a ballast water chamber 106.

In FIGS. 6, 6A and 7 there are ghost lines 103 that represent the top profile of the skirts as they are affixed to the hull 22.

Adjacent the front end 92 of skirts 26 are air bleed openings 108. When the craft slows and begins to submerge, air will exit openings 108 to prevent a water bubble from being trapped in the ballast water chamber 106 as best seen in FIG. 6. The water surrounds the hull 22 in the hollow skirts 26 and floods the ballast water chamber 106. When the watercraft moves forward by increasing the jet thrust, water in the skirt and water chamber 106 will be evacuated out through the water opening 104, as best seen in FIG. 6A and the triangular opening 107 such evacuation will allow air to enter and the watercraft 20 to move upward to its final running position as seen in FIG. 7.

At the rear of the watercraft 20 a hand hold 116 may be fitted to the hull 22 to assist a rider in mounting the watercraft 20. In addition other holds (not shown) may be provided to be used to lift and carry the watercraft 20 for loading and unloading.

In front of the seat 48 within the hull 22 a storage compartment 118 may be formed. There is a cover 120, see FIGS. 1 and 2.

Figure 10:
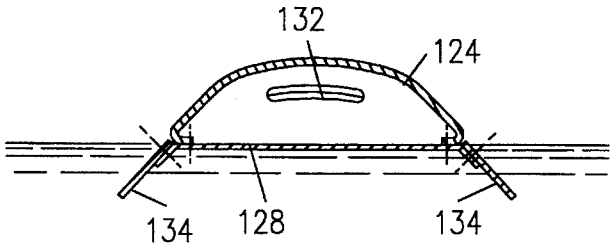
FIG. 10 is cross sectional view of the watercraft ski taken on line 10—10 of FIG. 6A.

The front ski designated 24 includes a very unique construction. The ski is in the form of a rear open ended pontoon with an outer skin that is slightly curved forming top portion 124 as it moves forwardly to a tapered rounded soft bumper like front end 126. It then curves under forming a bottom surface 128. The rear end 130 is open, and at the front end there is vent or water intake slot 132 at the front of the pontoon which acts as both water intake and air bleed. See FIG. 10.

In addition, the inventor provides a pair of water side ways resistant wing fence members 134. These members 134 act as fences or drags so that the watercraft 20 will be prevented from shifting sideways while turning in the water. These wing fence members 134 are optional with the rider. If they are removed the watercraft 20 will have more of a tendency to slide into turns rather than keep a true curve as the front ski member 24 is turned.

The steering mechanism designated 28 includes elongated steering column 140 that passes through the drive column tube 58 and has one end 142 secured to the front ski 24. The column 140 extends upward and out of the tube 58 where it terminates in an adjustable handle bar 144 which preferably includes hand grips 146.

In order to activate the engine 72 and accelerate the same the right hand grip 146 may be twisted, turned, or pulled and connected to a throttle and with conversion linkage to the engine 72 increase or decrease the speed of the watercraft 20.

The left hand grip 146 optionally may be rotational to control the jet nozzle 82 size. By a cable 148 as seen in FIG. 8, rotation of the hand grip 146 will cause the cable 148 to extend or retract. The cable 148 will pass to the jet nozzle 82, where it will engage a shutter, reduction or expansion arrangement (not shown) within the jet nozzle to restrict or expand the orifice to increase or decrease the water thrust through the nozzle to increase or decrease the speed of the watercraft.

In addition, above the handle bar 144 there are preferably provided an instrument pod 150, see FIGS. 8 and 9. Various instruments 152 may be provides such as warning lights, a fuel gauge, RPM's, etc.

Also another unique feature of the present invention is the provision of a second steering mechanism 30. This is best seen in FIGS. 6, 6A and 7. The steering column 140 is fitted with a bell crank 154 and a cable 156 that extends rearwardly to the jet nozzle 82 which as discussed above is horizontally pivotally mounted for horizontal movement. Thus, if the handle bar is turned to the left to make a left turn, the cable 156 will move and cause the jet nozzle 82 to swivel or rotate to the left also. With this arrangement a much smaller radius positive turn may be executed which in the case of races can mean the saving of valuable time in making turns.

In operation this unique watercraft 20 differs over the prior art as follows. When the craft 20 is at rest as seen in FIG. 6, all of the ballast water chambers 106 and the interior 160 of the ski 24 will be filled with water 162. The water will enter the opening 132 and the rear opening of the front ski and front opening 108 and the rear openings of the side skirt members 26 so that the watercraft 20 is submersed as seen in FIG. 6. As can be seen the top surfaces 94 of the skirts can be fitted with an anti-skid material 164 and will act as a foot rest. With the surfaces 94 well below the water level 166 it is easy for a rider to approach the craft from the rear, step on the foot rest area, and using the hand holder 116 straddle the craft and mount the seat 48. The watercraft 20 is still partially submerged and its balance will be easily maintained due to the water pressure surrounding the craft 20.

In addition, with the ballast chambers full of water and with the positioning of the engine 72 there is a very low center of gravity below the water line, see the center line 170 so that swaying or tipping to one side to tip over is greatly minimized. In addition, the forward-aft-center of gravity takes place on the FIG. 9—9 in FIG. 6. This again assists in unusual stability and front to rear balance and control.

Now returning to the operation, once the rider is mounted on the watercraft 20, the throttle is advanced on the watercraft 20 and it will start forward as seen in FIG. 6A. At this point water 162 that is in the respective cavities is expelled out the rear openings in the front ski 24 and the side skirt openings 107 and the large opening 104 at the rear of the craft 20. This in turn will allow the cavities of the craft 20 to take on air and become more buoyant as air replaces the water 162.

Finally, with all the water 162 evacuated and replaced by air as seen in FIG. 7 the watercraft is in position for full operation on the water or just under the water level 166 for maximum operation.

As the craft 20 is slowed the reverse occurs and water will then pass through the watercraft inlet openings to fill the chambers and the watercraft begins to submerge in the water and the FIG. 6 position is achieved.

While the invention has been described in its preferred embodiments it should be noted that the craft 20 could be formed where the front ski member 24 is fixed and the turning of the craft is accomplished solely by turning the jet nozzle 82 as previously described. Also the craft could be shaped in any manner to achieve a center of gravity below the waterline when at rest by surrounding a large portion of the craft with water when at rest and then having forward movement cause the craft to lift from the water.

In addition, in the case of less experienced riders the craft 20 could be fitted with additional side-skirts 174 that contain additional water ballast chambers, see FIG. 12. In this way there is a broader base to prevent the craft from tipping over either while submerged or in particular when the water has been evacuated and the craft 20 is at full capacity to move on top of the water. The second skirts 174 may be affixed to the first skirts in any appropriate manner.

A seat latch 176 may also be provided to remove the seat 48 from the craft 20 so that it may act as a float, as best seen in FIG. 13.

Finally with regard to either the first or second pairs of side skirts 26 or 174 they may be fitted with rails that extend above the top surfaces to prevent the rider's feet from slipping off the top.

It is also important to note that a preferred embodiment of the watercraft 20 is to have a construction where the beam of the craft, that is the widest section across the craft is approximately twenty four inches. Looking at FIG. 2 that would be toward the rear in a vertical line down from the curved rear end 44 of the craft to the side skirt members 22.

With such a structure as just discussed, the width of the bottom plate 70 is also reduced. Thus as a craft 20 of the above beam moves into a turn the surface of the bottom will not be tipped out of the water so that the water intact 88 will have less chance of being exposed to air so that cavitation will not occur. Cavitation results when the jet pump 80 receives all air or part air and water. This is not desired because the pump losses its capacity to operate efficiently in an all water medium and the craft 20 can stall or decelerate until normalcy is restored.

Further in a craft of a twenty four inch beam the opening or intake 88 is preferably one third of the total bottom plate width. Thus this results in a lesser volume of water entering the pump.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A water jet powered watercraft to hold a rider that straddles the craft and steers the craft by means of a handle bar to control the speed and the direction of the craft wherein there is a main hull that is hollow having a bottom surface and a seat on the top of said hull and mounted upon said bottom surface is an engine to power a water pump impeller to force water into a jet nozzle at great velocity whereby the water is expelled through an orifice in said jet nozzle to cause forward movement of said craft, said watercraft further including;

a front ski member separate from said main hull, said ski member includes a ballast cavity means capable of being filled with water when said watercraft is at rest to assist in partially submersing said watercraft for ease of mounting said craft, yet capable of expelling water therefrom with forward motion of said craft, whereby said craft may ride on or near the surface of said water;

a pair of side skirt means adapted to be fitted to the sides of said hull for stability and each to act as a foot rest for said rider and each including ballast cavity means capable of being filled with water when said watercraft is at rest to also assist in partially submersing said watercraft for ease of mounting said craft, yet capable of expelling water therefrom with forward motion of said craft, whereby said craft may ride on or near the surface of said water; and steering means extending through said hull to control the direction of travel of said watercraft.

2. A water jet powered watercraft as defined in claim 1 wherein said steering means includes:

a steering shaft from said handle bar through said hull terminating in fixed engagement with said front ski so that rotation of said handle bar will rotate said front ski in a direction relative to the rotation of said handle bar.

3. A water jet powered watercraft as defined in claim 1 wherein said steering means includes;

said jet nozzle being horizontally rotatably mounted; and cable means interconnecting said handle bar and said jet nozzle to cause said jet nozzle to rotate in the direction of the rotation of said handle bar to direct said watercraft.

4. A water jet powered watercraft as defined in claim 3 wherein said cable means includes:

a bell crank associated with said handle bar to direct the movement of said cable and in turn the horizontal movement of said jet nozzle.

5. A water jet powered watercraft as defined in claim 1 wherein said steering means includes dual steering means;

a steering column tube extending generally vertically through said hull adjacent a front end of said hull;

a steering shaft from said handle bar passing through said hull and terminating in fixed engagement with said front ski for simultaneous rotation of said handle bar and said ski;

said jet nozzle being horizontally rotatably mounted; and cable means interconnecting said handle bar and said jet nozzle to cause said jet nozzle to simultaneously rotate with said front ski for turning said watercraft during forward movement thereof.

6. A water jet powered watercraft as defined in claim 1 wherein said front ski includes:

a bottom planing surface and a curved upper portion each of which has a tapered front portion forming a rounded front end having a water intake opening therein, the parts forming a hollow interior water ballast chamber and said water intake opening communicates with said water ballast chamber, and the rear of said ski has a water intake and outlet opening;

said ski adapted to take in water at said water intake openings when said craft is at rest and fill said ballast chamber causing said craft to partially submerge, yet of such a construction that forward movement of said craft will evacuate water from said ballast chamber out said rear outlet opening whereby said ski will be filled with air and become buoyant.

7. A water jet powered watercraft as defined in claim 1 including;

restrictive means to vary the orifice size of said jet nozzle to increase the thrust of said nozzle; and control means on said steering means to control said thrust by said rider.

8. A water jet powered watercraft as defined in claim 7 wherein said restrictive means includes:

an adjustable shutter across the path of said jet water thrust to open or close the passage through which said water passes; and said control means includes cable means extending from the steering means to said nozzle shutter.

9. A jet powered watercraft as defined in claim 1 wherein each of said side skirts include:

an elongated hollow member with a generally horizontal top portion, and inner surface contoured to fit around one side of said hull, and an elevated contoured rear portion to define a water ballast chamber when interfitted with said other side skirt and engaging said hull, said skirt having an exterior relatively smooth tapered surface; and said skirt along its length is hollow forming a water ballast chamber communicating with said rear chamber formed by said joined elevated contoured rear portions, a water exit opening at the rear end of said skirt and at the rear end of said elevated contoured rear portions, and a water intake air bleed opening at the front of said skirt; and said skirts each adapted to take in water or expel air at said water intake openings when said craft is at rest and fill both said water ballast chambers causing said craft to partially submerge, yet of such a construction that forward movement of said craft will cause water to flow from said chambers out said two exit openings whereby said skirts will be filled with air and become buoyant so said hull may move out of the water without water weight restriction upon forward movement.

10. A water jet powered watercraft as defined in claim 9 wherein said front ski includes:

a bottom planning surface and a curved upper portion each of which has a tapered front portion forming a rounded front end having a water intake opening therein, the parts forming a hollow interior water ballast chamber and said water intake opening communicates with said water ballast chamber, and the rear of said ski has a water intake and outlet opening;

said ski adapted to take in water at said water intake opening and said rear opening when said craft is at rest and fill said ballast chamber causing said craft to partially submerge, yet of such a construction that forward movement of said craft will evacuate water to flow from said ballast chamber out said rear outlet opening whereby said ski will be filled with air and become buoyant.

11. A water jet powered watercraft as defined in claim 10 wherein:

when said ski and said skirts are filled with water said watercraft will be stabilized and partially submerged to no greater than two thirds of the total height of said watercraft; and said skirts are submerged to a point making the mounting of said watercraft by a rider and positioning on the craft with feet on the skirts relatively easy due to a relatively low center of gravity.

12. A water jet powered watercraft as defined in claim 6 wherein said front ski includes:

a pair of canted wing members projecting downward and outward from said bottom of said ski to provide directional stability and prevent sideways slipping of said craft during turns in water.

13. A water jet powered watercraft as defined in claim 9 wherein;

a pair of second side skirts each conforming to the exterior elongated shape of a said first side skirt member and being attached thereto and extending outwardly of said hull to increase the lateral stability of said craft and to control the side to side tipping of said craft, said second skirts each having water ballast chambers that may be filled with water to assist in the increase of lateral stability.

14. A water jet powered watercraft as defined in claim 1 wherein;

the beam of the craft is approximately twenty four inches.

15. A water jet powered watercraft for riding on or near the surface of water comprising;

a main hull having a water proof chamber and a seat on the top thereof adapted to receive a rider, said hull also including an exterior bottom plate opposite said seat;

an internal combustion engine mounted adjacent said exterior bottom plate including an exhaust system and a muffler interfitted within said exhaust system all within said water proof chamber;

a water intake opening formed through said bottom plate and an annular water channel communicating with said opening and extending rearwardly therefrom;

a submerged water jet pump mounted on said plate rearwardly of said engine in said water channel and a drive shaft connecting said engine and said jet pump to rotate said pump;

a steering jet nozzle in line with and associated with said jet pump rearwardly thereof to receive water at great velocity so that water expelled through said jet nozzle causes forward movement of said craft;

a front ski member separate from said main hull, said ski member includes a ballast cavity means capable of being filled with water when said craft is at rest to assist in partially submersing said craft for ease of mounting said craft by said rider, yet capable of expelling water therefrom with forward motion of said craft, whereby said craft may ride on or near the surface of said water;

a pair of first side skirt means adapted to be fitted to the sides of said hull for stability and each to act as a foot rest for said rider and each including ballast cavity means capable of being filled with water when said watercraft is at rest to also assist in partially submersing said craft for ease of mounting said craft, yet capable of expelling water therefrom with forward motion of said craft whereby said craft may ride on or near the surface of said water; and steering means including a handle bar for gripping by said rider to control the direction of travel of said watercraft.

16. A water jet powered watercraft as defined in claim 15 wherein said steering means includes:

a steering shaft from said handle bar through said hull terminating in fixed engagement with said front ski so that rotation of said handle bar will rotate said front ski in a direction relative to the rotation of said handle bar.

17. A water jet powered watercraft as defined in claim 15 wherein said steering means includes:

said jet nozzle being horizontally rotatably mounted; and cable means interconnecting said handle bar and said jet nozzle to cause said jet nozzle to rotate in the direction of the rotation of said handle bar to direct said watercraft.

18. A water jet powered watercraft as defined in claim 17 wherein said cable means includes:

a bell crank associated with said handle bar to direct the movement of said cable and in turn the horizontal movement of said jet nozzle.

19. A water jet powered watercraft as defined in claim 15 wherein said steering means includes dual steering means:

a steering column tube extending generally vertically through said hull adjacent a front end of said hull;

a steering shaft from said handle bar passing through said hull and terminating in fixed engagement with said front ski for simultaneous rotation of said handle bar and said ski;

said jet nozzle being horizontally rotatably mounted; and cable means interconnecting said handle bar and said jet nozzle to cause said jet nozzle to simultaneously rotate with said front ski for turning said watercraft during forward movement thereof.

20. A water jet powered watercraft as defined in claim 15 wherein each of said side skirts include:

an elongated hollow member with a generally horizontal top portion, and inner surface contoured to fit around one side of said hull, and an elevated contoured rear portion to define a water ballast chamber when interfitted with said other side skirt and engaging said hull, said skirt having an exterior relatively smooth tapered surface; and said skirt along its length is hollow forming a water ballast chamber communicating with said chamber formed by said joined elevated contoured rear portions, a water exit opening at the rear end of said skirt and at the rear end of said elevated contoured rear portions, and a water intake opening at the front of said skirt; and said skirts each adapted to take in water at said water intake opening and at said rear opening when said craft is at rest and fill both said water ballast chambers causing said craft to partially submerge, yet of such a construction that forward movement of said craft will force water from said chambers out said two exit openings whereby said skirts will be filled with air and become buoyant so said hull may move out of the water upon forward movement.

21. A water jet powered watercraft as defined in claim 20 wherein:

a bottom planing surface and a curved upper portion each of which has a tapered front portion forming a rounded front end having a water intake opening therein, the parts forming a hollow interior water ballast chamber and said water intake opening communicates with said water ballast chamber, and the rear of said ski has a water intake and outlet opening;

said ski adapted to take in water at said water intake openings and at said rear opening when said craft is at rest and fill said ballast chamber causing said craft to partially submerge, yet of such a construction that forward movement of said craft will force water to flow from said ballast chamber out said rear outlet opening whereby said ski will be filled with air and become buoyant.

22. A water jet powered watercraft as defined in claim 21 wherein:

when said ski and said skirts are filled with water said watercraft will be stabilized and partially submerged to no greater than two thirds of the total height of said watercraft; and said skirts are submerged to a point making the mounting on said watercraft by a rider and positioning by said rider on the craft with feet on the skirts relatively easy due to a relatively low center of gravity.

23. A water jet powered watercraft as defined in claim 20 wherein:

a pair of second side skirts each conforming to the exterior elongated shape of a said first side skirt member and being attached thereto and extending outwardly of said hull to increase the lateral stability of said craft and to control the side to side tipping of said craft; said second skirts each having water ballast chambers that may be filled with water to assist in the increase of lateral stability.

24. A water jet powered watercraft as defined in claim 15 wherein:

said watercraft has a beam of approximately twenty four inches.

25. A water jet powered watercraft as defined in claim 24 wherein:

said water intake is approximately one third the total width of said bottom plate.

* * * * *